US010869507B2

(12) United States Patent
Zheng et al.

(10) Patent No.: US 10,869,507 B2
(45) Date of Patent: Dec. 22, 2020

(54) ELECTRONIC CIGARETTE AND ATOMIZER THEREOF

(71) Applicant: Shenzhen First Union Technology Co., Ltd., Shenzhen (CN)

(72) Inventors: Min Zheng, Shenzhen (CN); Zhongli Xu, Shenzhen (CN); Yonghai Li, Shenzhen (CN)

(73) Assignee: Shenzhen First Union Technology Co., Ltd., Guangdong (CN)

( * ) Notice: Subject to any disclaimer, the term of this patent is extended or adjusted under 35 U.S.C. 154(b) by 407 days.

(21) Appl. No.: 15/990,553

(22) Filed: May 25, 2018

(65) Prior Publication Data

US 2018/0338538 A1 Nov. 29, 2018

(30) Foreign Application Priority Data

May 27, 2017 (CN) ..... 2017 2 0607806 U

(51) Int. Cl.

| | |
|---|---|
| ***A24F 13/00*** | (2006.01) |
| ***A24F 17/00*** | (2006.01) |
| ***A24F 25/00*** | (2006.01) |
| ***A24F 47/00*** | (2020.01) |
| ***H05B 3/44*** | (2006.01) |
| ***H05B 1/02*** | (2006.01) |
| ***H05B 3/48*** | (2006.01) |

(52) U.S. Cl.

CPC ..... *A24F 47/008* (2013.01); *H05B 1/0227* (2013.01); *H05B 3/44* (2013.01); *H05B 3/48* (2013.01)

(58) Field of Classification Search

CPC ..... A24F 47/008; A24F 47/002; A24F 47/00; A24F 40/40; A24F 40/485; A24F 40/95; A24F 42/60

USPC ..... 131/329

See application file for complete search history.

(56) References Cited

U.S. PATENT DOCUMENTS

| | | | | |
|---|---|---|---|---|
| 10,631,573 | B2 * | 4/2020 | Qiu | A24F 40/42 |
| 2018/0020738 | A1 * | 1/2018 | Qiu | A24F 47/008 131/329 |
| 2018/0160736 | A1 * | 6/2018 | Qiu | A61M 15/06 |

(Continued)

FOREIGN PATENT DOCUMENTS

| | | |
|---|---|---|
| CN | 204 796 750 U | 11/2015 |
| CN | 205 757 176 U | 12/2016 |
| EP | 3 123 880 A1 | 2/2017 |

*Primary Examiner* — Abdullah A Riyami
*Assistant Examiner* — Thang H Nguyen
(74) *Attorney, Agent, or Firm* — Proi Intellectual Property US; Klaus Michael Schmid

(57) ABSTRACT

An atomizer in an electronic cigarette is disclosed including an aerosol outlet tube; an air inlet tube; a heating element; an atomizing shell and a heating base; the air inlet tube is sleeved on the aerosol outlet tube and a first air inlet passage is formed between the air inlet tube and the aerosol outlet tube; a first aerosol outlet passage is formed inside the aerosol outlet tube; the heating element is disposed in the heating base; the atomizing shell is sleeved on the heating base; a second air inlet passage and a second aerosol outlet passage are spaced and arranged between the atomizing shell and the heating base, along a circumferential direction of the heating base; the first air inlet passage and the second air inlet passage are communicated to allow exterior air to pass through then to flow into the heating base.

18 Claims, 5 Drawing Sheets

(56) References Cited

U.S. PATENT DOCUMENTS

| | | | | |
|---|---|---|---|---|
| 2018/0199631 | A1* | 7/2018 | Chen | A61M 15/06 |
| 2018/0213845 | A1* | 8/2018 | Qiu | H05B 3/03 |
| 2018/0271174 | A1* | 9/2018 | Qiu | A24F 40/49 |
| 2018/0303166 | A1* | 10/2018 | Qiu | A24F 47/00 |
| 2019/0124994 | A1* | 5/2019 | Qiu | A24F 47/008 |
| 2019/0307974 | A1* | 10/2019 | Qiu | A24F 40/10 |
| 2020/0120988 | A1* | 4/2020 | Qiu | A24F 40/57 |

* cited by examiner

ELECTRONIC CIGARETTE AND ATOMIZER THEREOF

TECHNICAL FIELD

The present disclosure relates to the field of electronic cigarettes, and in particular, to an electronic cigarette and an atomizer thereof.

BACKGROUND ART

An electronic cigarette in the current market has an atomizer, the atomizer is provided herein for storing and heating the tobacco liquid to generate an aerosol. A heating element in the atomizer generates heat after conducted by the electricity, to heat the tobacco liquid in the atomizer. Apart from heating the tobacco liquid, the heating element may act as an aerosol tube because of a hollow structure itself, outputting the atomized aerosol to an aerosol outlet tube.

The electronic cigarette in the prior art isn't applied for various heating elements without the aerosol tube.

SUMMARY

In view of the drawbacks in the electronic cigarette and the atomizer thereof known to the inventors, the present disclosure generally relates to an electronic cigarette and an atomizer thereof, applied for heating elements in different structures.

To overcome the above shortages, the present disclosure relates to an atomizer including:

an aerosol outlet tube, an air inlet tube, a heating element, an atomizing shell and a heating base; the air inlet tube is sleeved on the aerosol outlet tube and a first air inlet passage is formed between the air inlet tube and the aerosol outlet tube; a first aerosol outlet passage is formed inside the aerosol outlet tube; the heating element is disposed in the heating base; the atomizing shell is sleeved on the heating base; in which, a second air inlet passage and a second aerosol outlet passage are spaced and arranged between the atomizing shell and the heating base, along a circumferential direction of the heating base; the first air inlet passage and the second air inlet passage are communicated to allow exterior air to pass through then to flow into the heating base; the first aerosol outlet passage and the second aerosol outlet passage are communicated to allow the aerosol aerosolized by the heating element inside the heating base to pass through then to flow out.

Further, the heating base and the atomizing shell are all cylindrical structures, and an outer circumferential surface of the heating base is divided along the circumferential direction thereof into an aerosol outlet area, an air inlet area and an abutting area; the aerosol outlet area and the air inlet area are separated by the abutting area; the abutting area abuts the atomizing shell, a clearance is formed between the aerosol outlet area and the atomizing shell to form the second air inlet passage and a clearance is formed between the air inlet area and the atomizing shell to form the second aerosol outlet passage.

Further, the abutting area is curved surface, a diameter of the curved surface is equal to an inner diameter of the atomizing shell; the aerosol outlet area and the air inlet area are sectional surfaces set along an axial direction of the heating base.

Further, the heating base includes an air inlet and an aerosol outlet respectively corresponding with the air inlet area and the aerosol outlet area, allowing the exterior air inputted by the first air inlet passage and the second air inlet passage to flow into the heating base via the air inlet, as well as allowing the aerosol aerosolized in the heating base to flow into the second aerosol outlet passage and the first aerosol outlet passage via the aerosol outlet.

Further, the atomizer further includes an atomizing shell cover, disposed at an end of the atomizing shell toward the aerosol outlet tube and the air inlet tube; the atomizing shell cover has a first hole; an end of the air inlet tube abuts outside the first hole, the aerosol outlet tube extends into the atomizing shell via the first hole; a clearance is formed between an outer surface of the aerosol tube and a side surface of the first hole, to allow the exterior air inputted by the first air inlet passage to pass through then to flow into the atomizing shell.

Further, the atomizing shell cover has a flange disposed outside of the first hole, an end of the air inlet tube and the flange are elastically inserted.

Further, the atomizer further includes a sealing element, the sealing element is partially disposed in the atomizing shell and abuts between the heating base and the aerosol outlet tube; the sealing element has a second hole communicated with the first aerosol outlet passage; a surface of the heating base abutting the sealing element or a surface of the sealing element abutting the heating base has a groove, configured for communicating the second aerosol outlet passage and the second hole; the sealing element is further set to seal the second aerosol outlet passage but expose the second air inlet passage, thus allowing the exterior air inputted by the first air inlet passage to flow into the second air inlet passage, while allowing the aerosol outputted by the second aerosol outlet passage to flow into the groove, then flow into the first aerosol outlet passage via the second hole.

Further, the atomizer includes a housing, sleeved on the atomizing shell, a liquid storage chamber is formed between the housing and the atomizing shell; the atomizing shell and the heating base corresponding to the abutting area have an liquid inlets, allowing the tobacco liquid from the liquid storage chamber to flow into the heating base via the liquid inlets.

Further, the atomizer includes an absorbing body abutting between the heating element and the heating base, and configured for absorbing the tobacco liquid from the liquid inlet and supplying the tobacco liquid to the heating element for aerosolizing.

In order to solve the above problem, another embodiment can be referred that discloses an electronic cigarette including the aforementioned atomizer.

Compared to the prior art known to the inventors, provided herein are an electronic cigarette and an atomizer thereof. The atomizer includes an aerosol outlet tube, an air inlet tube, a heating element, an atomizing shell and a heating base; the air inlet tube is sleeved on the aerosol outlet tube and a first air inlet passage is formed between the air inlet tube and the aerosol outlet tube; a first aerosol outlet passage is formed inside the aerosol outlet tube; the heating element is disposed in the heating base; the atomizing shell is sleeved on the heating base; in which, a second air inlet passage and a second aerosol outlet passage are spaced and arranged between the atomizing shell and the heating base, along a circumferential direction of the heating base; the first air inlet passage and the second air inlet passage are communicated to allow exterior air to pass through then to flow into the heating base; the first aerosol outlet passage and the second aerosol outlet passage are communicated to allow the aerosol aerosolized inside the heating base to pass through then to flow out. Therefore, the atomizer may include the air inlet passage and the aerosol outlet passage formed therein by the aerosol outlet tube, the air inlet tube, the atomizing shell and the heating base, no need of relying on a hollow structure of the heating element to convey the air/aerosol, which is applied for various heating elements in different structures.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
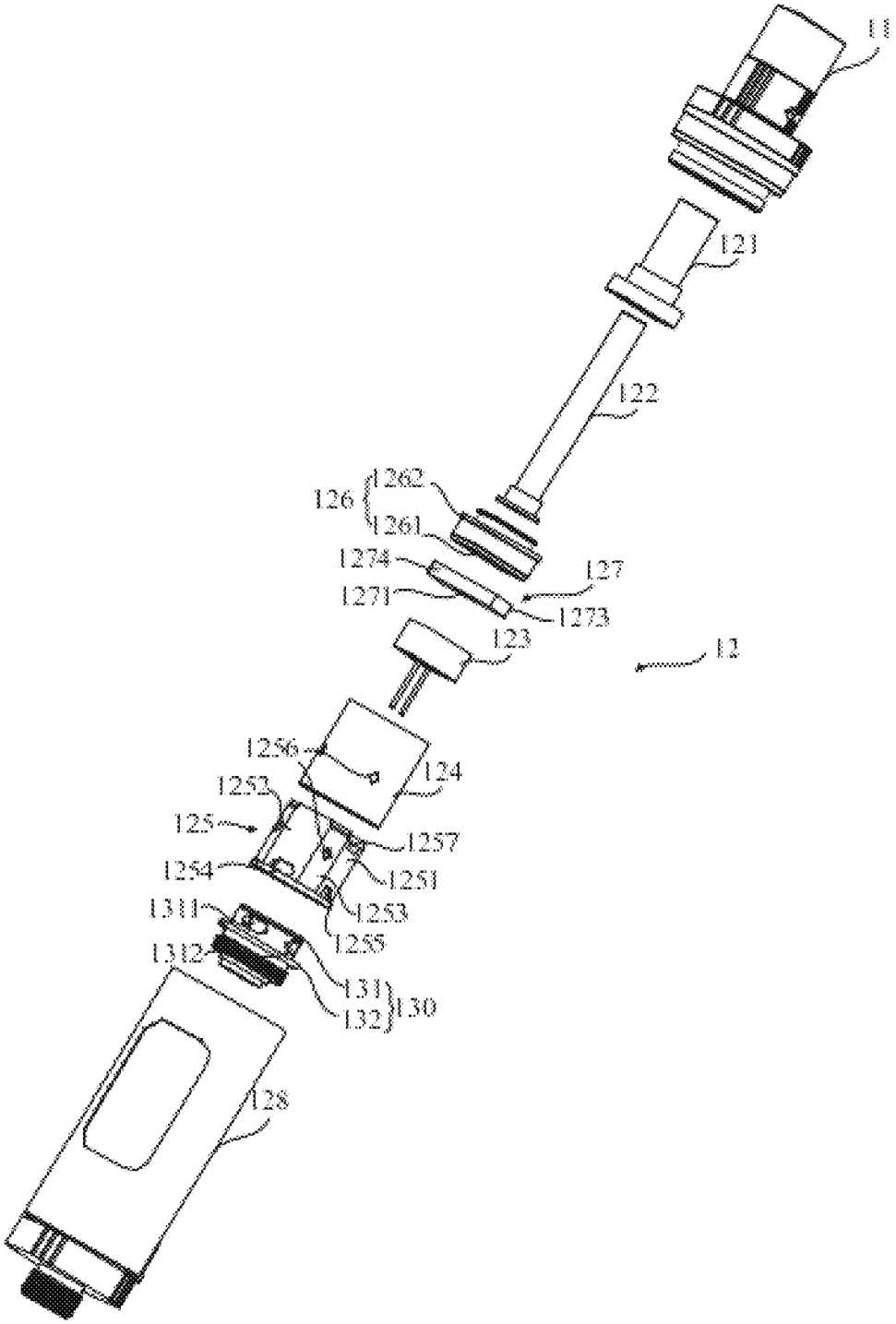
FIG. 1 is an exploded isometric view of an electronic cigarette according to an embodiment of the present disclosure.
Figure 2:
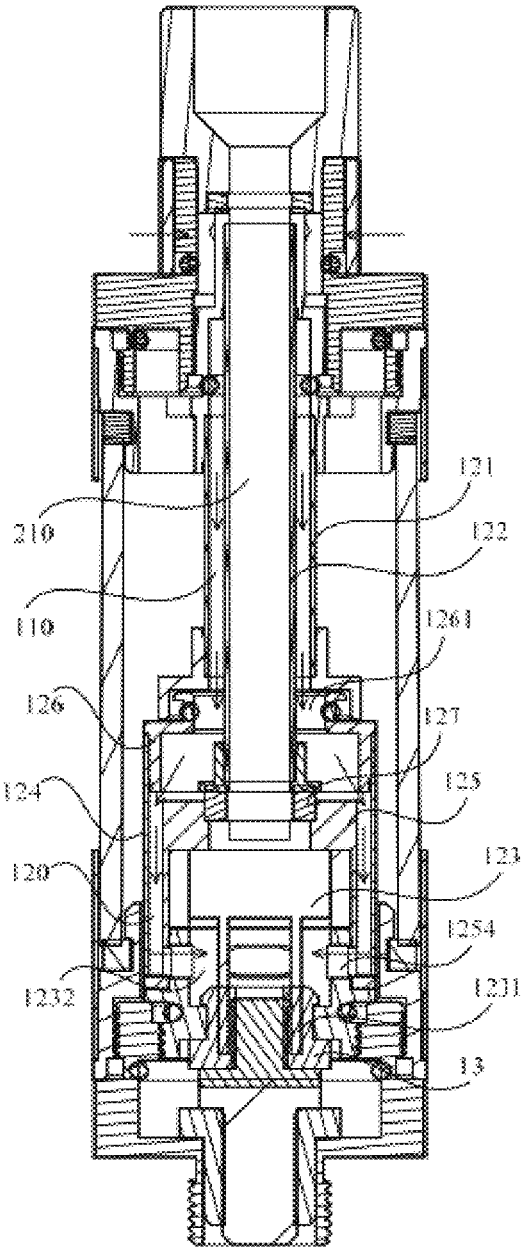
FIG. 2 is a sectional view of an electronic cigarette according to an embodiment of the present disclosure.
Figure 3:
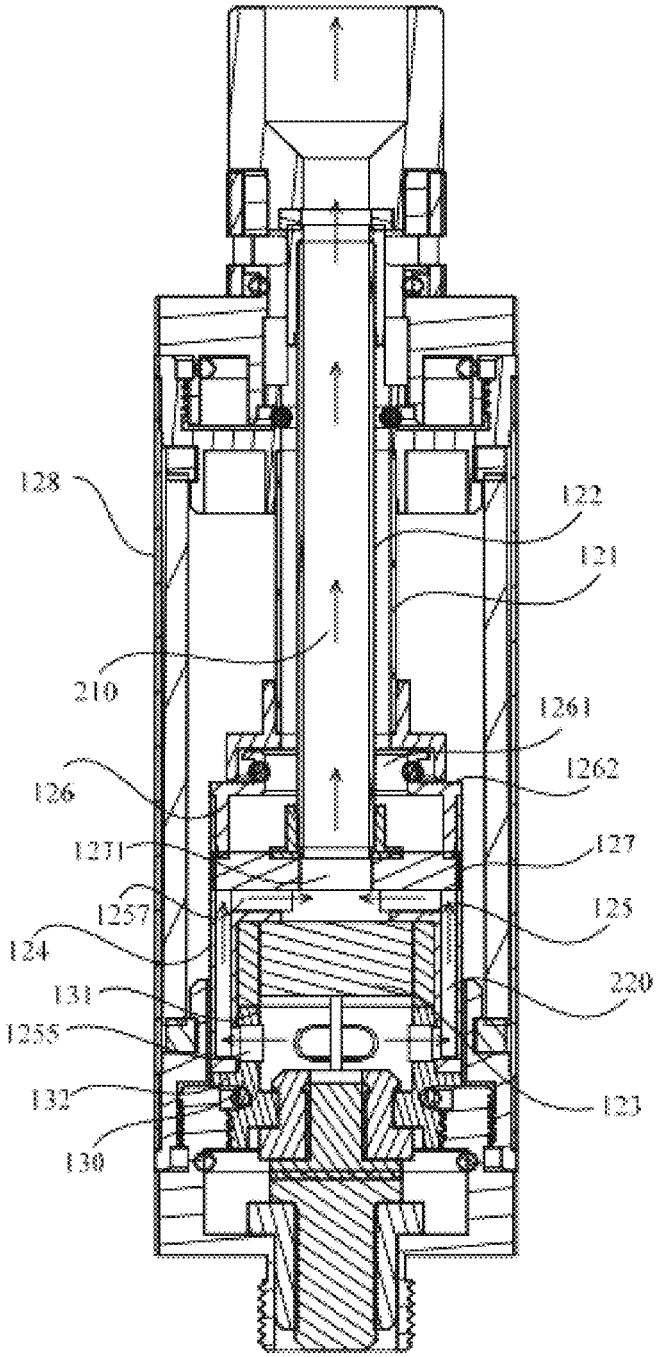
FIG. 3 is another sectional view of an electronic cigarette according to an embodiment.
Figure 4:
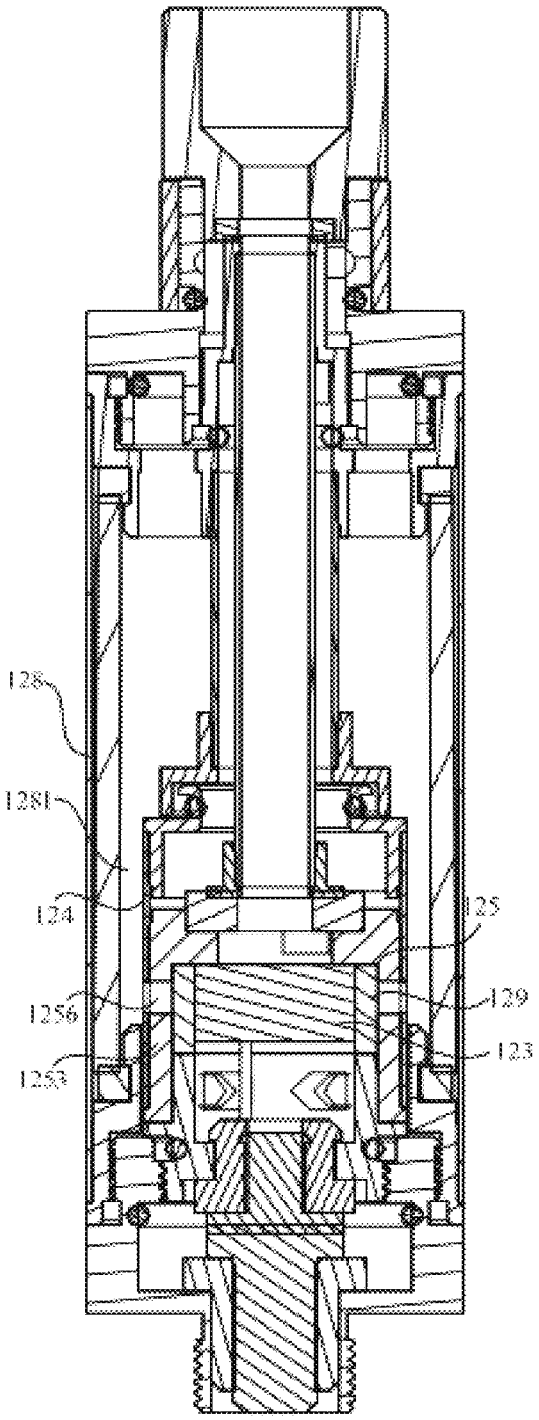
FIG. 4 is one more sectional view of an electronic cigarette according to an embodiment.

Referring to FIG. 1 and FIG. 4, FIG. 1 is an exploded isometric view of an electronic cigarette according to an embodiment of the present disclosure. FIG. 2 is a sectional view of an electronic cigarette according to an embodiment of the present disclosure. FIG. 3 is another sectional view of an electronic cigarette according to an embodiment. FIG. 4 is one more sectional view of an electronic cigarette according to an embodiment. In which, specially, FIG. 2 is a sectional view along an air inlet area of an atomizing base of the electronic cigarette; FIG. 3 is a sectional view along an aerosol outlet area of the atomizing base of the electronic cigarette, FIG. 4 is a sectional view along an abutting area of the atomizing base of the electronic cigarette. As shown in FIG. 1 to FIG. 4, the electronic cigarette 10 includes a mouth piece 11, an atomizer 12 and a power supply 13. The mouth piece 11 and the power supply 13 are respectively disposed at two ends of the atomizer 12. The power supply 13 is configured for supplying power to the atomizer 12. The atomizer 12 heats the tobacco liquid to generate an aerosol, then sucked by a user via the mouth piece 11.

The atomizer 12 includes an aerosol outlet tube 121, an air inlet tube 122, a heating element 123, an atomizing shell 124 and a heating base 125; the air inlet tube 122 is sleeved on the aerosol outlet tube 121 and a first air inlet passage 110 is formed between the air inlet tube 122 and the aerosol outlet tube 121; a first aerosol outlet passage 210 is formed inside the aerosol outlet tube 122; the heating element 123 is disposed in the heating base 125; the atomizing shell 124 is sleeved on the heating base 125; in which, a second air inlet passage 120 and a second aerosol outlet passage 220 are spaced and arranged between the atomizing shell 124 and the heating base 125, along a circumferential direction of the heating base 125; the first air inlet passage 110 and the second air inlet passage 120 are communicated to allow exterior air to pass through then to flow into the heating base 125; the first aerosol outlet passage 210 and the second aerosol outlet passage 220 are communicated to allow the aerosol aerosolized by the heating element 13 inside the heating base 125 to pass through, then to flow out. As shown in FIG. 3, those arrows' direction shows a direction of the aerosol flowing.

As a result, in the embodiment, the atomizing shell 12 may include an independent air inlet passage and aerosol outlet passage formed therein by the aerosol outlet tube 121, the air inlet tube 122, the atomizing shell 124 and the heating base 125, no need of relying on the heating element 12 to convey the aerosol, which is applied for various heating elements 13 in different structures.

Figure 5:
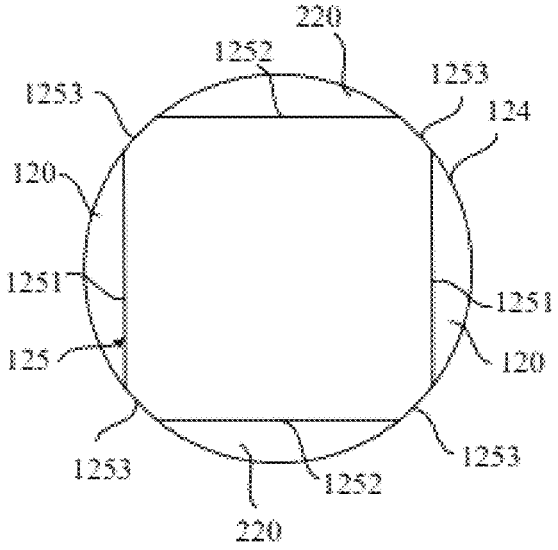
FIG. 5 is an illustrative view of an electronic cigarette incorporating the atomizing shell and the heating base assembled together according to an embodiment.

In the embodiment, the heating base 125 and the atomizing shell 124 are all cylindrical structure, and the circumferential surface of the heating base 125 is divided along the circumferential direction thereof into an aerosol outlet area 1251, an air inlet area 1252 and an abutting area 1253; the aerosol outlet area 1251 and the air inlet area 1252 are separated by the abutting area 1253; the abutting area 1253 abuts the atomizing shell 124, a clearance is formed between the aerosol outlet area 1251 and the atomizing shell 124 to form the second air inlet passage 120 and a clearance is formed between the air inlet area 1252 and the atomizing shell 124 to form the second aerosol outlet passage 220. As shown FIG. 5, in which, the number of the air inlet areas 1252 is two, so is the number of the aerosol outlet area 1251; the two air inlet areas 1252 are opposite with each other, so are the aerosol outlet areas 1251. The abutting areas 1253 have four abutting areas 1253, respectively disposed between the air inlet areas 1252 and the aerosol outlet areas 1251 to separate the air inlet areas 1252 from the aerosol outlet areas 1251.

In some embodiments, the abutting area 1253 may a curved surface, and a diameter of the curved surface is equal to an inner diameter of the atomizing shell 124, to cause the abutting area 1253 entirely contacting an inner surface of the atomizing shell 124, which may seal and separate the aerosol outlet areas 1251 from the air inlet areas 1252, thus the second aerosol outlet passage 220 formed by the aerosol outlet area 1251 and the second air inlet passage 120 formed by the air inlet area 1252 are separated, without communication interactively; the aerosol outlet area 1251 and the air inlet area 1252 are sectional surfaces set along an axial direction of the heating base 124.

In other embodiments, the diameter of the curved surface of the abutting area 1253 is slightly larger than an inner diameter of the atomizing shell 124, thus when the heating base 125 is assembled into the atomizing shell 124, the abutting area 1253 of the heating base 125 makes elastic deformation to let the heating base 125 assembled into the atomizing shell 124.

In other embodiments, the abutting area 1253 may be a tangent plane the same as the air inlet area 1252 and the aerosol outlet area 1251, further some components made of soft materials such as silica gel or rubber etc. may be added between the abutting area 1253 and the atomizing shell 124, to seal and separate the aerosol outlet area 1251 and the air inlet area 1252.

Further, the heating base 125 includes an air inlet 1254 and an aerosol outlet 1255 respectively corresponding with the air inlet area 1252 and the aerosol outlet area 1251, allowing the exterior air inputted by the first air inlet passage 110 and the second air inlet passage 120 to flow into the heating base 125 via the air inlet 1254, as well as allowing the aerosol aerosolized by the heating element 123 in the heating base 125 to flow into the second aerosol outlet passage 220 and the first aerosol outlet passage 210 via the aerosol outlet 1255.

In some embodiments, the heating element 123 may be heated from the bottom thereof, which will be illustrated later. In which, the air inlet 1254 and the aerosol outlet 1255 may be set at different heights, such as the air inlet 1254 may be set at an end of the air inlet area 1252 far away from the heating element 123, whereas, the location of the aerosol outlet 1255 may be higher than that of the air inlet 1254, between the bottom of the heating element 123 and the air inlet 1254, which may accelerate the aerosol outputting so as to avoid mixture of the aerosol with the exterior air.

Further, the atomizer 12 further includes an atomizing shell cover 126, disposed at an end of the atomizing shell 124 toward the aerosol outlet tube 122 and the air inlet tube 121; the atomizing shell cover 126 has a first hole 1261; an end of the air inlet tube 121 abuts outside the first hole 1261. More specifically, the atomizing shell cover 126 has a flange 1262 disposed outside of the first hole 1261, an end of the air inlet tube 121 and the flange 1262 are elastically coupled with each other in a plug-in manner. The aerosol outlet tube 122 extends into the atomizing shell 124 via the first hole 1261; a clearance is formed between an outer surface of the aerosol tube 122 and a side surface of the first hole 1261, to allow the exterior air inputted by the first air inlet passage 110 to pass through then to flow into the atomizing shell 124.

Further, the atomizer 12 further includes a sealing element 127, the sealing element 127 is partially disposed in the atomizing shell 124 and abuts between the heating base 125 and the aerosol outlet tube 122; the sealing element 127 has a second hole 1271 communicated with the first aerosol outlet passage 110; a surface of the heating base 125 abutting the sealing element 127 or a surface of the sealing element 127 abutting the heating base 125 has a groove 1257, configured for communicating the second aerosol outlet passage 220 and the second hole 1271. In the embodiment, the groove 1257 is disposed on the surface of the heating base 125 abutting the sealing element 127. In other embodiments, the groove 1257 is disposed on the surface of the sealing element 127 abutting the heating base 125. Or the surface of the heating base 125 abutting the sealing element 127 and the surface of the sealing element 127 abutting the heating base 125 both have the grooves.

The sealing element 127 is further set to seal the second aerosol outlet passage 220 but expose the second air inlet passage 120 to the air, thus allowing the exterior air inputted by the first air inlet passage 110 to flow into the second air inlet passage 120, while allowing the aerosol outputted by the second aerosol outlet passage 220 to flow into the groove 1257, then flow into the first aerosol outlet passage 210 via the second hole 1271. More specifically, Outside surface of the sealing element 127 may be divided into an aerosol outlet part 1273 and an air inlet part 1274. In which, the aerosol outlet part 1273 is a curved surface, and a diameter thereof is equal to the inner diameter of the atomizing shell 124 to make the curved surface of the aerosol outlet part 1273 entirely contact the atomizing shell 124 so as to block the exterior air and the aerosol. Also, the diameter of the curved surface of the aerosol outlet part 1273 is slightly larger than the inner diameter of the atomizing shell 124, thus when the sealing element 127 is assembled into the atomizing shell 124, the sealing element 127 makes elastic deformation to let the sealing element 127 be assembled into the atomizing shell 124. The air inlet part 1274 may be set to have a same tangent plane with the air inlet area 1252, which may let the second air inlet passage 120 in communication with the air inlet passage 110.

In the embodiments, the sealing element 127 may be made of any one of silica gel or rubber etc.

Further, the atomizer 12 includes a housing 128, sleeved on the atomizing shell 124, a liquid storage chamber 1281 is formed between the housing 128 and the atomizing shell 124; the atomizing shell 124 and the heating base 125 corresponding to the abutting area 1253 have an liquid inlets 1256, allowing the tobacco liquid from the liquid storage chamber 1256 to flow into the heating base 125 via the liquid inlets 1256.

Further, the atomizer 12 further includes an absorbing body 129 abutting between the heating element 123 and the heating base 125, and configured for absorbing the tobacco liquid from the liquid inlets 1256 and supplying the tobacco liquid to the heating element 123 for aerosolizing. More specifically, the heating element 123 may be made of ceramic materials, so that the tobacco liquid absorbed by the absorbing body 129 may pass through the side surface of the heating element 123 and then flow to the bottom of the heating element 123. A heating piece is disposed at the bottom of the heating element 123 for heating the tobacco liquid. In the embodiment, the heating element 123 further includes heating electrodes 1231 that are electrically connected with the power supply 13.

Further, the atomizer 12 further includes an atomizing shell base 130 disposed at a distal end of the atomizing shell 124 from the sealing element 127. Meanwhile, the atomizing shell base 130 includes an abutting part 131 and an extending part 132, in which, the abutting part 131 is cylindrical, the absorbing body 129 protrudes out from the bottom of the heating element 123 to abut the abutting part 131, therefore, the bottom of the heating element 123 and the cylindrical abutting part 131 defines a heating space 1232. The extending part 132 protrudes out along the abutting part 131, the atomizing shell 124 and the heating base 125 respectively abuts against the extending part 132. Moreover, the abutting part 131 has an air inlet 1311 corresponding to location of the air inlet 1254 and an aerosol outlet 1312 corresponding to location of the aerosol outlet 1255, letting the exterior air from the second air inlet passage 120 that is formed by the atomizing shell 124 and the heating base 125 flow into the heating space 1232 via the air inlets 1311 and 1254, while letting the aerosol aerosolized by the heating element 123 at the bottom of the heating element 123 flow out from the aerosol outlets 1255 and 1312, also flow out from the second aerosol outlet passage 220 that is formed by the atomizing shell 124 and the heating base 125.

Therefore, the electronic cigarette 10 in the present disclosure may be applied for various heating elements 123 in different structures.

Terminology used herein is for the purpose of describing particular embodiments only and is not intended to be limiting of the invention. Variations may be made to the embodiments and methods without departing from the spirit of the disclosure. Accordingly, it is appropriate that the appended claims be construed broadly and in a manner consistent with the scope of the disclosure.

What is claimed is:

1. An atomizer for an electronic cigarette comprising:

an aerosol outlet tube;

an air inlet tube;

a heating element;

an atomizing shell and a heating base;

wherein, the air inlet tube is sleeved on the aerosol outlet tube and a first air inlet passage is formed between the air inlet tube and the aerosol outlet tube; a first aerosol outlet passage is formed inside the aerosol outlet tube; the heating element is disposed in the heating base; the atomizing shell is sleeved on the heating base;

wherein, a second air inlet passage and a second aerosol outlet passage are spaced and arranged between the atomizing shell and the heating base, along a circumferential direction of the heating base; the first air inlet passage and the second air inlet passage are communicated with each other to allow exterior air to pass through and then to flow into the heating base; the first aerosol outlet passage and the second aerosol outlet passage are communicated with each other to allow the aerosol aerosolized by the heating element inside the heating base to pass through and then to flow out.

2. The atomizer according to claim 1, wherein the heating base and the atomizing shell are all cylindrical structures, and an outer circumferential surface of the heating base is divided along the circumferential direction thereof into an aerosol outlet area, an air inlet area and an abutting area; the aerosol outlet area and the air inlet area are separated by the abutting area; the abutting area abuts the atomizing shell; a clearance is formed between the aerosol outlet area and the atomizing shell to form the second air inlet passage and a clearance is formed between the air inlet area and the atomizing shell to form the second aerosol outlet passage.

3. The atomizer according to claim 2, wherein the abutting area is a curved surface, a diameter of the curved surface is equal to an inner diameter of the atomizing shell; the aerosol outlet area and the air inlet area are tangent planes set along an axial direction of the heating base.

4. The atomizer according to claim 2, wherein the heating base comprises an air inlet and an aerosol outlet respectively corresponding with the air inlet area and the aerosol outlet area, allowing exterior air inputted by the first air inlet passage and the second air inlet passage to flow into the heating base via the air inlet, as well as allowing the aerosol aerosolized in the heating base to flow into the second aerosol outlet passage and the first aerosol outlet passage via the aerosol outlet.

5. The atomizer according to claim 2, wherein the atomizer further comprises an atomizing shell cover, disposed at an end of the atomizing shell toward the aerosol outlet tube and the air inlet tube; the atomizing shell cover has a first hole; an end of the air inlet tube abuts outside the first hole, the aerosol outlet tube extends into the atomizing shell via the first hole; a clearance is formed between an outer surface of the aerosol tube and a side surface of the first hole, to allow the exterior air inputted by the first air inlet passage to pass through and then to flow into the atomizing shell.

6. The atomizer according to claim 5, wherein the atomizing shell cover has a flange disposed outside of the first hole; an end of the air inlet tube and the flange are elastically coupled with each other in a plug-in manner.

7. The atomizer according to claim 5, wherein the atomizer further comprises a sealing element, the sealing element is partially disposed in the atomizing shell and abuts between the heating base and the aerosol outlet tube; the sealing element has a second hole communicated with the first aerosol outlet passage; a surface of the heating base abutting the sealing element or a surface of the sealing element abutting the heating base has a groove, the groove is configured for communicating the second aerosol outlet passage and the second hole; the sealing element is further configured to seal the second aerosol outlet passage but expose the second air inlet passage, thus allowing the exterior air inputted by the first air inlet passage to flow into the second air inlet passage, while allowing the aerosol outputted by the second aerosol outlet passage to flow into the groove, and then to flow into the first aerosol outlet passage via the second hole.

8. The atomizer according to claim 2, wherein the atomizer further comprises a housing, sleeved on the atomizing shell, a liquid storage chamber is formed between the housing and the atomizing shell; the atomizing shell and the heating base corresponding to the abutting area have an liquid inlet, allowing the tobacco liquid from the liquid storage chamber to flow into the heating base via the liquid inlet.

9. The atomizer according to claim 8, wherein the atomizer further comprises an absorbing body abutting between the heating element and the heating base, and configured for absorbing the tobacco liquid from the liquid inlet and supplying the tobacco liquid to the heating element for aerosolizing.

10. An electronic cigarette comprising:

an atomizer comprising:

an aerosol outlet tube;

an air inlet tube;

a heating element;

an atomizing shell and a heating base;

wherein, the air inlet tube is sleeved on the aerosol outlet tube and a first air inlet passage is formed between the air inlet tube and the aerosol outlet tube; a first aerosol outlet passage is formed inside the aerosol outlet tube; the heating element is disposed in the heating base; the atomizing shell is sleeved on the heating base;

wherein, a second air inlet passage and a second aerosol outlet passage are spaced and arranged between the atomizing shell and the heating base, along a circumferential direction of the heating base; the first air inlet passage and the second air inlet passage are communicated with each other to allow exterior air to pass through and then to flow into the heating base; the first aerosol outlet passage and the second aerosol outlet passage are communicated with each other to allow the aerosol aerosolized by the heating element inside the heating base to pass through and then to flow out.

11. The electronic cigarette according to claim 10, wherein the heating base and the atomizing shell are all cylindrical structures, and an outer circumferential surface of the heating base is divided along the circumferential direction thereof into an aerosol outlet area, an air inlet area and an abutting area; the aerosol outlet area and the air inlet area are separated by the abutting area; the abutting area abuts the atomizing shell; a clearance is formed between the aerosol outlet area and the atomizing shell to form the second air inlet passage and a clearance is formed between the air inlet area and the atomizing shell to form the second aerosol outlet passage.

12. The electronic cigarette according to claim 11, wherein the abutting area is a curved surface, a diameter of the curved surface is equal to an inner diameter of the atomizing shell; the aerosol outlet area and the air inlet area are tangent planes set along an axial direction of the heating base.

13. The electronic cigarette according to claim 11, wherein the heating base comprises an air inlet and an aerosol outlet respectively corresponding with the air inlet area and the aerosol outlet area, allowing exterior air inputted by the first air inlet passage and the second air inlet passage to flow into the heating base via the air inlet, as well as allowing the aerosol aerosolized in the heating base to flow into the second aerosol outlet passage and the first aerosol outlet passage via the aerosol outlet.

14. The electronic cigarette according to claim 11, wherein the atomizer further comprises an atomizing shell cover, disposed at an end of the atomizing shell toward the aerosol outlet tube and the air inlet tube; the atomizing shell cover has a first hole; an end of the air inlet tube abuts outside the first hole, the aerosol outlet tube extends into the atomizing shell via the first hole; a clearance is formed between an outer surface of the aerosol tube and a side surface of the first hole, to allow the exterior air inputted by the first air inlet passage to pass through and then to flow into the atomizing shell.

15. The electronic cigarette according to claim 14, wherein the atomizing shell cover has a flange disposed outside of the first hole; an end of the air inlet tube and the flange are elastically coupled with each other in a plug-in manner.

16. The electronic cigarette according to claim 14, wherein the atomizer further comprises a sealing element, the sealing element is partially disposed in the atomizing shell and abuts between the heating base and the aerosol outlet tube; the sealing element has a second hole communicated with the first aerosol outlet passage; a surface of the heating base abutting the sealing element or a surface of the sealing element abutting the heating base has a groove, the groove is configured for communicating the second aerosol outlet passage and the second hole; the sealing element is further configured to seal the second aerosol outlet passage but expose the second air inlet passage, thus allowing the exterior air inputted by the first air inlet passage to flow into the second air inlet passage, while allowing the aerosol outputted by the second aerosol outlet passage to flow into the groove, and then to flow into the first aerosol outlet passage via the second hole.

17. The electronic cigarette according to claim 11, wherein the atomizer further comprises a housing, sleeved on the atomizing shell, a liquid storage chamber is formed between the housing and the atomizing shell; the atomizing shell and the heating base corresponding to the abutting area have an liquid inlet, allowing the tobacco liquid from the liquid storage chamber to flow into the heating base via the liquid inlet.

18. The electronic cigarette according to claim 17, wherein the atomizer further comprises an absorbing body abutting between the heating element and the heating base, and configured for absorbing the tobacco liquid from the liquid inlet and supplying the tobacco liquid to the heating element for aerosolizing.

* * * * *